US008164476B2

(12) United States Patent
Hache et al.

(10) Patent No.: US 8,164,476 B2
(45) Date of Patent: Apr. 24, 2012

(54) WELLBORE TELEMETRY SYSTEM AND METHOD

(75) Inventors: Jean-Michel Hache, Bourg la Reine (FR); Remi Hutin, New Ulm (FR); Raghu Madhavan, Houston, TX (US); David Santoso, Sugar Land, TX (US)

(73) Assignee: IntelliServ, LLC, Houston, TX (US)

( * ) Notice: Subject to any disclaimer, the term of this patent is extended or adjusted under 35 U.S.C. 154(b) by 0 days.

(21) Appl. No.: 12/873,772

(22) Filed: Sep. 1, 2010

(65) Prior Publication Data

US 2010/0328096 A1 Dec. 30, 2010

Related U.S. Application Data

(63) Continuation of application No. 11/648,041, filed on Dec. 29, 2006, which is a continuation-in-part of application No. 11/228,111, filed on Sep. 16, 2005, now abandoned.

(51) Int. Cl.
*G03V 3/00* (2006.01)

(52) U.S. Cl. ..... 340/854.4; 340/854.9; 166/66; 166/248; 166/254.2

(58) Field of Classification Search ..... 340/854.4, 340/854.9; 166/66, 248, 254.2
See application file for complete search history.

(56) References Cited

U.S. PATENT DOCUMENTS 2,000,716 A 5/1935 Polk
2,096,359 A 10/1937 Hawthorn
4,012,092 A 3/1977 Godbey
4,057,781 A 11/1977 Scherbatskoy
4,095,865 A 6/1978 Denison et al.
4,098,342 A * 7/1978 Robinson et al. ..... 166/385
4,126,848 A 11/1978 Denison
4,176,894 A 12/1979 Godbey
4,722,402 A 2/1988 Weldon
4,953,636 A 9/1990 Mohn
5,517,464 A 5/1996 Lerner et al.
5,547,029 A 8/1996 Rubbo et al.
5,706,896 A 1/1998 Tubel et al.
5,721,376 A 2/1998 Pavone et al.
6,392,317 B1 5/2002 Hall et al.
6,641,434 B2 11/2003 Boyle et al.
6,670,880 B1 12/2003 Hall et al.
6,717,501 B2 4/2004 Hall et al.
6,768,700 B2 7/2004 Veneruso et al.
6,821,147 B1 11/2004 Hall et al.
6,830,467 B2 12/2004 Hall et al.
6,844,498 B2 1/2005 Hall et al.
6,866,306 B2 3/2005 Boyle et al.
6,888,473 B1 5/2005 Hall et al.
(Continued)

OTHER PUBLICATIONS

Office Action dated Oct. 12, 2007 for U.S. Appl. No. 11/228,111, 10 pages.

*Primary Examiner* — Timothy Edwards, Jr.
(74) *Attorney, Agent, or Firm* — Conley Rose, P.C.

(57) ABSTRACT

A hybrid telemetry system for passing signals between a surface control unit and a downhole tool is provided. The downhole tool is deployed via a drill string into a wellbore penetrating a subterranean formation. The hybrid telemetry system includes an uphole connector, a downhole connector, and a cable operatively connecting the uphole and downhole connectors. The uphole connector is operatively connectable to a drill string telemetry system for communication therewith. The downhole connector is operatively connectable to the downhole tool for communication therewith.

23 Claims, 11 Drawing Sheets

U.S. PATENT DOCUMENTS

| | | | | |
|---|---|---|---|---|
| 6,909,667 | B2 | 6/2005 | Shah et al. | |
| 6,913,093 | B2 | 7/2005 | Hall et al. | |
| 6,929,493 | B2 | 8/2005 | Hall et al. | |
| 7,040,415 | B2 * | 5/2006 | Boyle et al. | 175/40 |
| 7,080,699 | B2 * | 7/2006 | Lovell et al. | 175/40 |
| 7,096,961 | B2 | 8/2006 | Clark et al. | |
| 7,193,527 | B2 | 3/2007 | Hall et al. | |
| 7,198,118 | B2 | 4/2007 | Hall et al. | |
| 7,256,706 | B2 | 8/2007 | Haase et al. | |
| 2002/0075114 | A1 | 6/2002 | Hall et al. | |
| 2004/0035608 | A1 | 2/2004 | Meehan et al. | |
| 2004/0104797 | A1 | 6/2004 | Hall et al. | |
| 2004/0149471 | A1 | 8/2004 | Hall et al. | |
| 2004/0150532 | A1 | 8/2004 | Hall et al. | |
| 2004/0150533 | A1 | 8/2004 | Hall et al. | |
| 2004/0163822 | A1 | 8/2004 | Zhang et al. | |
| 2004/0217880 | A1 * | 11/2004 | Clark et al. | 340/854.9 |
| 2004/0219831 | A1 | 11/2004 | Hall et al. | |
| 2005/0001735 | A1 | 1/2005 | Hall et al. | |
| 2005/0001736 | A1 | 1/2005 | Hall et al. | |
| 2005/0001738 | A1 | 1/2005 | Hall et al. | |
| 2005/0046590 | A1 | 3/2005 | Hall et al. | |
| 2005/0067159 | A1 | 3/2005 | Hall et al. | |
| 2005/0074988 | A1 | 4/2005 | Hall et al. | |
| 2005/0087368 | A1 * | 4/2005 | Boyle et al. | 175/57 |
| 2005/0092499 | A1 | 5/2005 | Hall et al. | |
| 2005/0093296 | A1 | 5/2005 | Hall et al. | |
| 2005/0095827 | A1 | 5/2005 | Hall et al. | |
| 2005/0145406 | A1 | 7/2005 | Hall et al. | |
| 2005/0145416 | A1 | 7/2005 | Reed et al. | |
| 2005/0161215 | A1 | 7/2005 | Hall et al. | |
| 2006/0152383 | A1 | 7/2006 | Yamate et al. | |
| 2007/0017671 | A1 * | 1/2007 | Clark et al. | 166/248 |
| 2007/0030167 | A1 * | 2/2007 | Li et al. | 340/855.1 |
| 2009/0014175 | A1 | 1/2009 | Peter | |
| 2010/0116550 | A1 * | 5/2010 | Hutin et al. | 175/40 |

* cited by examiner

WELLBORE TELEMETRY SYSTEM AND METHOD

RELATED APPLICATION

This application is a continuation-in-part of U.S. application Ser. No. 11/228,111, filed Sep. 16, 2005, the contents of which are hereby incorporated by reference in their entirety.

BACKGROUND

1. Field of the Invention

The present invention relates to telemetry systems for use in wellbore operations. More particularly, the present invention relates to telemetry systems for providing power to downhole operations and/or for passing signals between a surface control unit and a downhole tool positionable in a wellbore penetrating a subterranean formation.

2. Background Art

The harvesting of hydrocarbons from a subterranean formation involves the deployment of a drilling tool into the earth. The drilling tool is driven into the earth from a drilling rig to create a wellbore through which hydrocarbons are passed. During the drilling process, it is desirable to collect information about the drilling operation and the underground formations. Sensors are provided in various portions of the surface and/or downhole systems to generate data about the wellbore, the earth formations, and the operating conditions, among others. The data is collected and analyzed so that decisions may be made concerning the drilling operation and the earth formations.

Telemetry systems are utilized in the analysis and control of wellbore operations and allow for analysis and control from a surface control station that may be located on site, or may be remote. The information gathered allows for more effective control of the drilling system and further provides useful information for analysis of formation properties and other factors affecting drilling. Additionally, the information may be used to determine a desired drilling path, optimum conditions or otherwise benefit the drilling process.

Various telemetry tools allow for the measuring and logging of various data and transmission of such data to a surface control system. Measurement while drilling (MWD) and logging while drilling (LWD) components may be disposed in a drill string to collect desired information. Various approaches have been utilized to pass data and/or power signals from the surface to the measurement and logging components disposed in the drillstring. These may include, for example, mud-pulse telemetry as described in U.S. Pat. No. 5,517,464, wired drill pipe as described in U.S. Pat. No. 6,641,434, and others.

Despite the development and advancement of telemetry devices in wellbore operations, there remains a need to provide additional reliability and telemetry capabilities. Like any other wellbore device, telemetry devices sometimes fail. Additionally, the power provided by telemetry devices may be insufficient to power desired wellbore operations. Moreover, it is often difficult to extend communication links through certain downhole tools, such as drilling jars. Furthermore, the couplings used in power and/or data transmission lines in a drillstring are often exposed to a harsh environment, such as variations and extremes of pressure and temperature, contributing to the failure rate of such transmission systems.

Accordingly, there remains a need to provide telemetry systems capable of extending across portions of the drill string and/or downhole tool. In some cases, it is desirable to provide redundancy to the existing telemetry system and/or to bypass portions of existing systems. It is further desirable that such a system provide simple and reliable operation and be compatible with a variety of tools and bottom hole assemblies (BHAs). Such techniques preferably provide one or more of the following, among others: increased speed, improved signal, reduced attenuation, increased reliability, increased data rate, protection for components of the downhole tool, reduced lost in hole time, easy access to telemetry components, synchronization between shallow and deep components, versatility, higher frequency content, reduced delay and distance to telemetry components, increased power capabilities and/or diagnostic capabilities.

SUMMARY OF INVENTION

In one aspect, the invention relates to a hybrid telemetry system for passing signals between a surface control unit and a downhole tool, the downhole tool deployed via a drill string into a wellbore penetrating a subterranean formation. The system includes an uphole connector operatively connectable to a drill string telemetry system for communication therewith, a downhole connector operatively connectable to the downhole tool for communication therewith, and a cable operatively connecting the uphole and downhole connectors.

In another aspect, the invention relates to a hybrid communication system for a wellsite passing signals between a surface control unit and a downhole tool, the downhole tool deployed via a drill string into a wellbore penetrating a subterranean formation. The system includes a drill string telemetry system disposed in the drillstring, the drill string telemetry system operatively connected to the surface unit for passing signals therebetween, and at least one hybrid telemetry system operatively connectable to the drill string telemetry system and the downhole tool for passing signals therebetween, wherein the hybrid telemetry system includes an uphole connector operatively connectable to a drill string telemetry system for communication therewith, a downhole connector operatively connectable to the downhole tool for communication therewith, and a cable operatively connecting the uphole and downhole connectors.

In another aspect, the invention relates to a method of passing signals between a surface control unit and a downhole tool via a hybrid telemetry system, the downhole tool deployed via a drill string into a wellbore penetrating a subsurface formation. The system includes operatively connecting a downhole end of the hybrid telemetry system to a downhole tool for communication therewith, positioning a drill string telemetry system in the drill string a distance from the downhole tool, operatively connecting an uphole end of the hybrid telemetry system to a drill string telemetry system for communication therewith, and passing a signal between the surface control unit and the downhole tool via the hybrid telemetry system.

Other aspects and advantages of the invention will be apparent from the following description and the appended claims.

DETAILED DESCRIPTION

Figure 1:
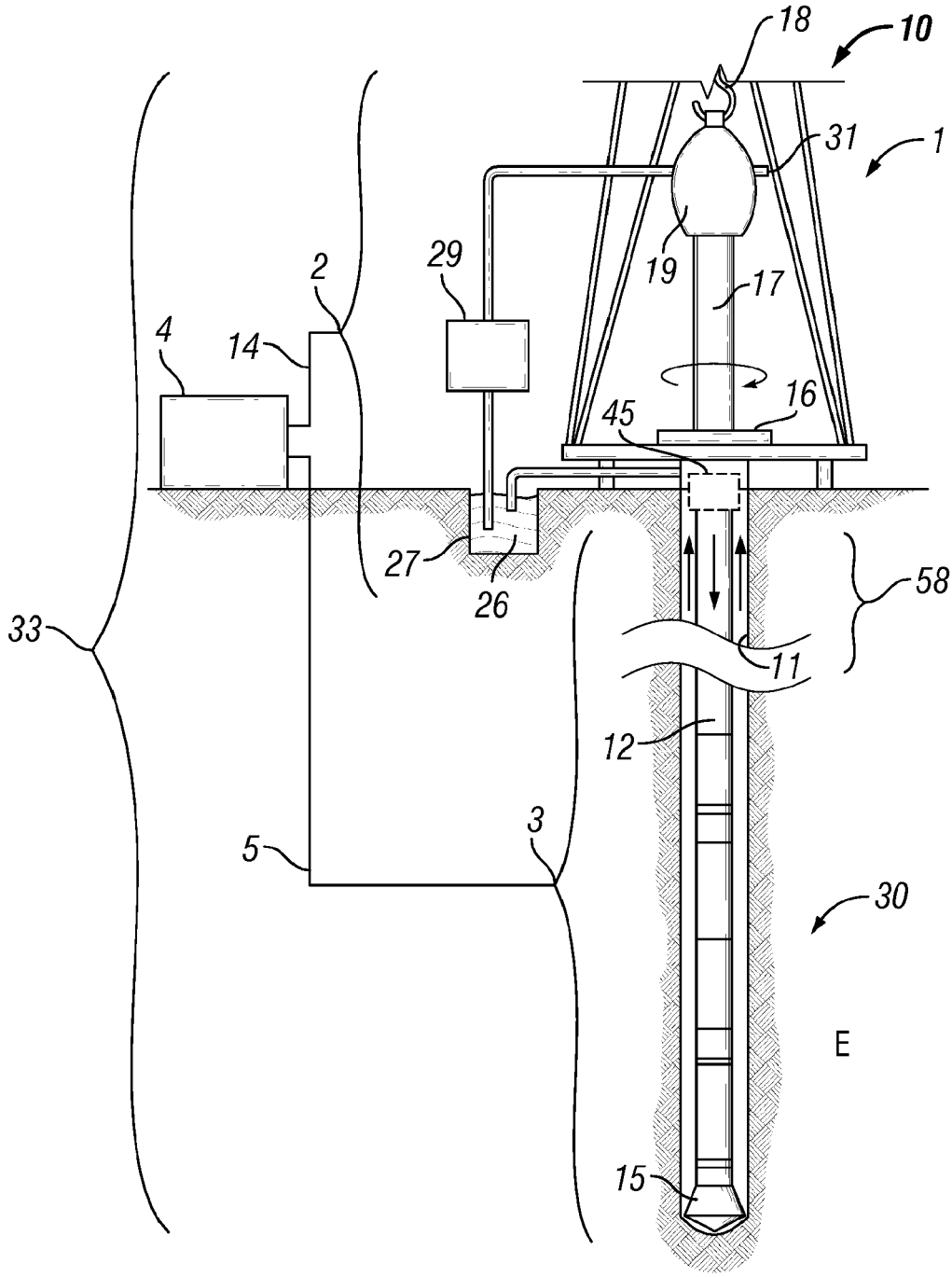
FIG. 1 shows a wellsite system provided with a wellbore communication system.

Specific embodiments of the invention will now be described in detail with reference to the accompanying figures. Like elements in the various figures are denoted by like reference numerals for consistency.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

FIG. 1 illustrates an example of a wellsite system 1 with which the present invention can be utilized to advantage. The wellsite system 1 includes a surface system 2, a downhole system 3, and a surface control unit 4. A borehole 11 is formed by rotary drilling. Those of ordinary skill in the art given the benefit of this disclosure will appreciate, however, that the present invention also may be utilized in drilling applications other than conventional rotary drilling (e.g., mudmotor based directional drilling), and their use is not limited to land-based rigs. Also, variations on the type of drilling system may be used, such as top drive, Kelly, or other systems.

The downhole system 3 includes a drill string 12 suspended within the borehole 11 with a drill bit 15 at its lower end. The surface system 2 includes a land-based platform and derrick assembly 10 positioned over the borehole 11 penetrating a subsurface formation F. The drill string 12 is rotated by a rotary table 16, which engages a kelly 17 at the upper end of the drill string 12. The drill string 12 is suspended from a hook 18, attached to a traveling block (not shown), through the kelly 17 and a rotary swivel 19 which permits rotation of the drill string 12 relative to the hook 18.

The surface system further includes drilling fluid or mud 26 stored in a pit 27 formed at the wellsite. A pump 29 delivers the drilling fluid 26 to the interior of the drill string 12 via a port in the swivel 19, inducing the drilling fluid 26 to flow downwardly through the drill string 12. The drilling fluid 26 exits the drill string 12 via ports in the drill bit 15, and then circulates upwardly through the region between the outside of the drill string 12 and the wall of the borehole, called the annulus. In this manner, the drilling fluid 26 lubricates the drill bit 15 and carries formation cuttings up to the surface as it is returned to the pit 27 for recirculation.

The drill string 12 further includes a downhole tool or bottom hole assembly (BHA), generally referred to as 30, near the drill bit 15. The BHA 30 includes components with capabilities for measuring, processing, and storing information, as well as communicating with the surface. The BHA 30 thus may include, among other things, at least one measurement tool, such as a logging-while-drilling tool (LWD) and/or measurement while drilling tool (MWD) for determining and communicating one or more properties of the formation F surrounding borehole 11, such as formation resistivity (or conductivity), natural radiation, density (gamma ray or neutron), pore pressure, and others. The MWD may be configured to generate and/or otherwise provide electrical power for various downhole systems and may also include various measurement and transmission components. Measurement tools may also be disposed at other locations along the drill string 12.

The measurement tools may also include a communication component, such as a mud pulse telemetry tool or system, for communicating with the surface system 2. The communication component is adapted to send signals to and receive signals from the surface. The communication component may include, for example, a transmitter that generates a signal, such as an electric, acoustic or electromagnetic signal, which is representative of the measured drilling parameters. The generated signal is received at the surface by a transducer or similar apparatus, represented by reference numeral 31, a component of the surface communications link (represented generally at 14), that converts a received signal to a desired electronic signal for further processing, storage, encryption, transmission and use. It will be appreciated by one of skill in the art that a variety of telemetry systems may be employed, such as wired drill pipe, electromagnetic telemetry, or other known telemetry systems.

A communication link may be established between the surface control unit 4 and the downhole system 3 to manipulate the drilling operation and/or gather information from sensors located in the drill string 12. In one example, the downhole system 3 communicates with the surface control unit 4 via the surface system 2. Signals are typically transmitted to the surface system 2, and then transferred from the surface system 2 to the surface control unit 4 via surface communication link 14. Alternatively, the signals may be passed directly from a downhole drilling tool to the surface control unit 4 via communication link 5 using electromagnetic telemetry (not shown) if provided. Additional telemetry systems, such as mud pulse, acoustic, electromagnetic, seismic and other known telemetry systems may also be incorporated into the downhole system 3.

The surface control unit 4 may send commands back to the downhole system 3 (e.g., through communication link 5 or surface communication link 14) to activate and/or control one or more components of the BHA 30 or other tools located in the drill string 12, and perform various downhole operations and/or adjustments. In this fashion, the surface control unit 4 may then manipulate the surface system 2 and/or downhole system 3. Manipulation of the drilling operation may be accomplished manually or automatically.

As shown in FIG. 1, the wellsite system 1 is provided with a wellbore communication system 33. The wellbore communication system 33 includes a plurality of wired drill pipes (WDPs) linked together to form a WDP telemetry system 58, to transmit a signal through the drill string 12. Alternatively, the WDP telemetry system 58 may be a wireless system extending through a plurality of drill pipes using a conductive signal. Signals are typically passed from the BHA 30 via the wired drill pipe telemetry system 58 to a surface telemetry sub 45. As shown, the surface telemetry sub 45 is positioned at the uphole end of the WDP telemetry system 58. However, in some cases, the surface telemetry sub 45 may be positioned above or adjacent to the kelly 17. The signals referred to herein may be communication and/or power signals.

Figure 2:
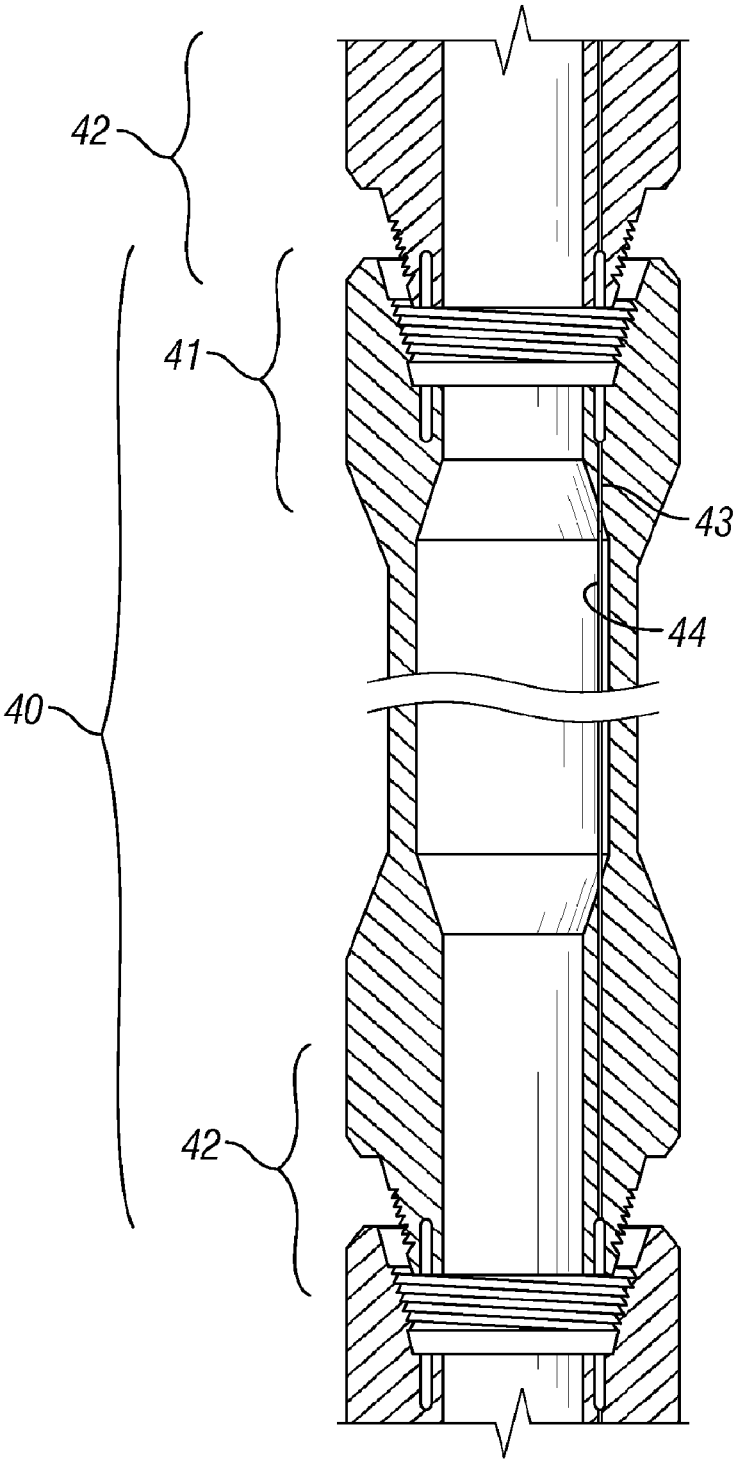
FIG. 2 (Prior Art)
FIG. 2 shows a prior art portion of a wired drill pipe telemetry system.

FIG. 2 shows a detailed portion of an optional WDP telemetry system usable as the WDP telemetry system of FIG. 1. The WDP telemetry system may be a system such as the one described in U.S. Pat. No. 6,641,434, the entire contents of which are hereby incorporated by reference. As shown in FIG. 2, a WDP 40 will typically include a first coupling element 41 at one end and a second coupling element 42 at a second end. The coupling elements 41, 42 are configured to transmit a signal across the interface between two adjacent components of the drill string 12, such as two lengths of WDP 40. Transmission of the signal across the interface may utilize any means known in the art, including but not limited to, inductive, conductive, optical, wired or wireless transmission.

WDP 40 may include an internal conduit 43 enclosing an internal electric cable 44. Accordingly, a plurality of operatively connected lengths of WDP 40 may be utilized in a drill string 12 to transmit a signal along any desired length of the drill string 12. In such fashion a signal may be passed between the surface control unit 4 of the wellsite system 1 and one or more tools disposed in the borehole 11, including MWDs and LWDs.

Figure 3A:
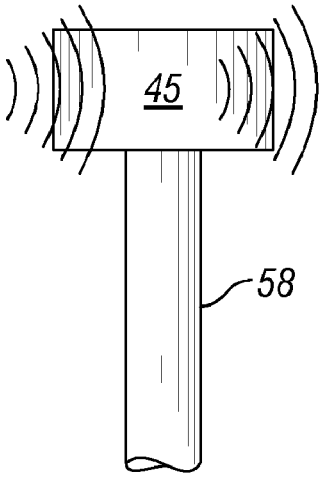
FIG. 3A shows a surface telemetry sub in accordance with an embodiment of the invention.

FIG. 3A shows the surface telemetry sub 45 of FIG. 1 in greater detail. The surface telemetry sub 45 is operatively connected to the WDP telemetry system 58 for communication therewith. The surface telemetry sub 45 may then operatively connect to the surface control unit 4 (FIG. 1). The surface telemetry sub 45 may be located at or near the top of the drill string 12, and may include a transmitter and/or receiver (such as transmitter/receiver 48 of FIG. 3B) for exchanging signals with the surface control unit 4 and/or one or more components of the surface system 2 in communication with one or more surface control units 4. As shown, the surface telemetry sub 45 can wirelessly communicate with the surface unit.

Figure 3B:
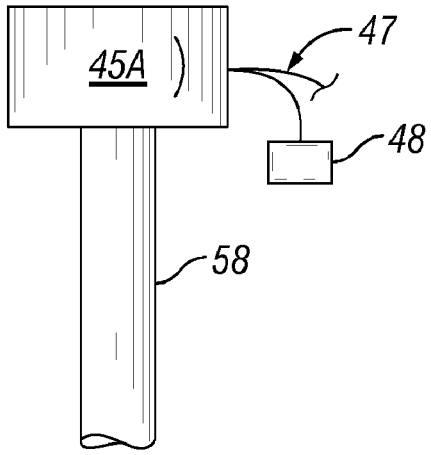
FIG. 3B shows a surface telemetry sub in accordance with another embodiment of the invention.

Alternatively, as shown in FIG. 3B, the surface telemetry sub 45*a* of the wellsite system 1 may comprise slip rings and/or a rotary transformer that may be operatively connected to the surface control unit 4 (FIG. 1) by means of a cable 47, a transmitter/receiver 48, a combination thereof, and/or any other means known in the art. Depending on configuration and other factors, the surface telemetry sub 45*a* may be disposed in an upper portion of the downhole system 3, in the surface system 2 of the wellsite system 1, or in an interface therebetween. The surface telemetry sub operatively connects the WDP telemetry system 58 and the surface control unit 4 (FIG. 1).

Either configuration of the surface telemetry sub (45, 45*a*) may be provided with wireless and/or hardwired transmission capabilities for communication with the surface control unit 4. Configurations may also include hardware and/or software for WDP diagnostics, memory, sensors, and/or a power generator.

Figure 4:
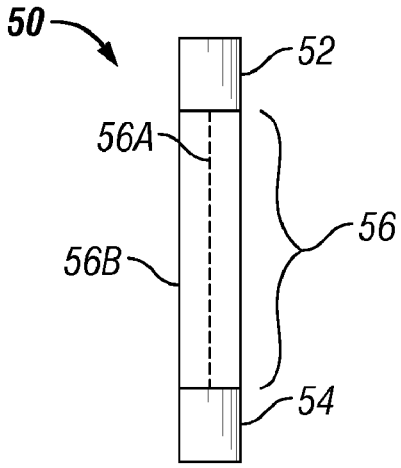
FIG. 4 shows a telemetry kit in accordance with an embodiment of the invention.

Referring now to FIG. 4, an example of a telemetry kit 50 is depicted. The telemetry kit includes a terminal 52 and a terminal 54 for operatively connecting a transmission element (generally represented at 56) for the transmission of a signal therebetween. Either or both of the terminals 52, 54 may comprise a sub, or alternatively may comprise a configuration of one or more components of a drill string (e.g., a collar, drill pipe, sub, or tool) such that the component will operatively connect to the transmission element 56.

The operative connection between transmission element 56 and terminal 52, 54 may be reversible. For example, terminal 52 may be at an uphole end and terminal 54 at a downhole end as shown. Alternatively, where end connectors are provided to establish connections to adjacent devices, the terminals may be switched such that terminal 54 is at an uphole end and terminal 52 is at a downhole end. A reversible connection advantageously facilitates the disposition of the transmission element 56 in the drillstring 12 during or after make-up of a particular section of the drillstring 12.

Transmission through and/or by a telemetry kit 50 may be inductive, conductive, optical, wired, or wireless. The mode of transmission is not intended to be a limitation on the telemetry kit 50, and therefore, the examples described herein, unless otherwise indicated, may be utilized with any mode of transmission.

As shown, the telemetry kit 50 preferably includes a cable 56*a* extending between the terminals 52, 54. However, in some cases, a cable may not be required. For example, in some cases, a specialized pipe 56*b* may be used. A specialized pipe, such as conductive pipe, may be used to pass signals between the terminals. In some cases, it may be possible to have wireless transmission between the terminals. Other apparatuses, such as electromagnetic communication systems capable of passing signals through the formation and/or kit, can be used for transmitting a signal between the terminals 52, 54.

When a cable 56*a* is used as a transmission element 56, the cable 56*a* may be of any type known in the art, including but not limited to wireline heptacable, coax cable, and mono cable. The cable may also include one or more conductors, and/or one or more optical fibers (e.g., single mode, multi mode, or any other optical fiber known in the art). Cables may be used to advantageously bypass stabilizers, jars, and heavy weights disposed in the BHA 30. It is also advantageous to have a cable that is able to withstand the drilling environment, and one that may support a field termination for fishing and removal of the cable.

The terminals 52, 54 may be configured to conduct signals through an operative connection with adjoining components. The terminal 54 may be used to operatively connect to the downhole tool or BHA. An interface may be provided for operative connection therewith. The terminals may interface, directly or through one or more additional components, with a downhole telemetry sub (not shown in FIG. 4) disposed downhole. The terminal 52 may be configured to operatively connect to a WDP telemetry system 58.

In one example, the terminal(s) may be configured to support the weight of various other components of the telemetry kit 50 through, e.g., a fishing neck, and may include an electrical and/or mechanical mechanism when utilized with cable to support and connect to the cable, while permitting transmission therethrough. The terminal(s) may also include an interface for operatively connecting to the WDP telemetry system 58 (FIG. 1). It may also be desirable to dispose other devices, such as a cable modems, one or more sensors, clocks, processor, memories, diagnostics, power generators and/or other devices capable of downhole operations, in the terminal (s) and/or the telemetry kit 50.

The terminal(s), for example when used with cable as the transmission element 56, may include a latch for reversibly locking the end of the cable and will also be configured to pass a signal. The reversible locking mechanism of the latch may be of any type known in the art, and may be configured to release upon sufficient tensile pull of the cable.

When cable is not used as a transmission element 56, it may be desirable to include a through-bore configuration in the terminal 54, to allow for fishing of downhole components. A cable modem, one or more sensors, memory, diagnostics, and/or a power generator may also be disposed in the second terminal 54.

The telemetry kit 50 may be configured to include one or more standard lengths of drill pipe and/or transmission element 56. The length of the kit may be variable. Variations in length may be achieved by cutting or winding that portion of the transmission element 56 that exceeds the distance required to operatively connect the terminals 52, 54, or by extending across various numbers of drill pipes. In one configuration where the transmission element 56 comprises a cable, one or more of the terminals 52, 54 may include a spool or similar configuration for the winding of excess cable.

The spool or similar configuration may be biased to exert and/or maintain a desired pressure on the cable, advantageously protecting the cable from damage due to variations in the distance between the terminals 52, 54. Such configurations further advantageously allow for the use of suboptimal lengths of cable for a particular transmission length, and for the use of standardized lengths of cable to traverse varying distances. When utilized with cable or other non-pipe transmission elements 56*a*, one or more drill pipes may also be disposed between the terminals 52, 54 of the telemetry kit 50. This drill pipe may be used to protect the transmission element 56 disposed therebetween and/or house components therein.

The telemetry kit 50 may be disposed to traverse at least a portion of the WDP telemetry system. By traversing a portion of the WDP system, at least a portion of the WDP system may be eliminated and replaced with the telemetry kit 50. In some cases, the telemetry kit 50 overlaps with existing WDP systems to provide redundancy. This redundancy may be used for added assurance of communication and/or for diagnostic purposes. For example, such a configuration may also advantageously provide a system for diagnosing a length of WDP by providing an alternative system for signal transmission such that signals transmitted through telemetry kit 50 may be compared to those transmitted through an overlapping portion of the WDP telemetry system. Differences between the signal transmitted through the telemetry kit 50 and those transmitted through the overlapping portion of the WDP telemetry system may be used to identify and/or locate transmission flaws in one or more WDPs. Furthermore, such differences may also be used to identify and/or locate transmission flaws in the telemetry kit 50.

The telemetry kit 50 may extend across one or more drill pipes in various portions of the drill string 12 and/or downhole tool. Various components, tools, or devices may be positioned in one or more of these drill pipes. In this way, the telemetry kit 50 may overlap with portions of the BHA and/or drill string and contain various components used for measurement, telemetry, power or other downhole functions.

Figure 5A:
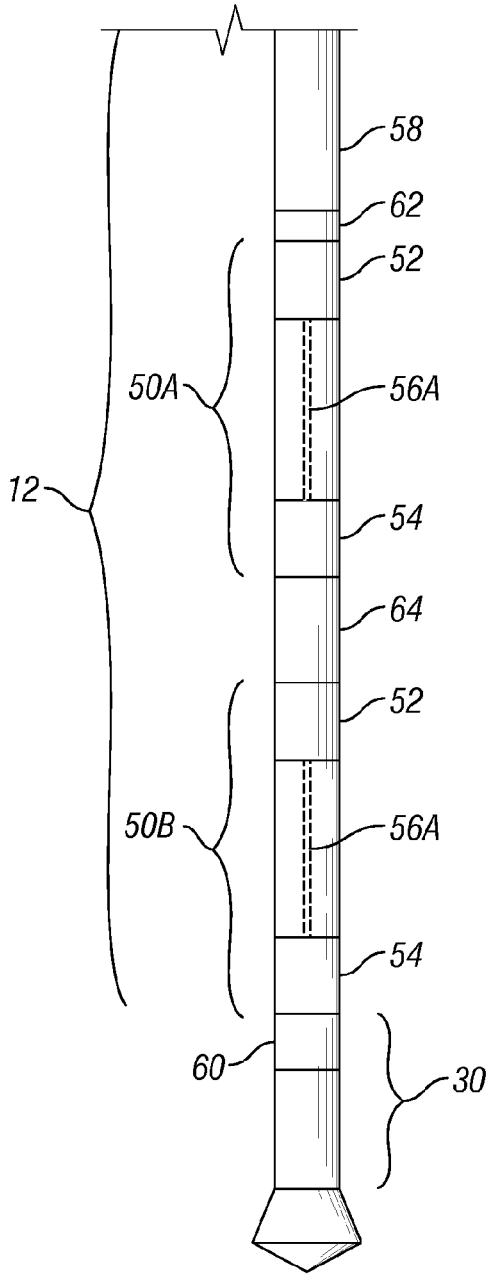
FIG. 5A shows a portion of a wellbore communication system in accordance with an embodiment of the invention.
Figure 5B:
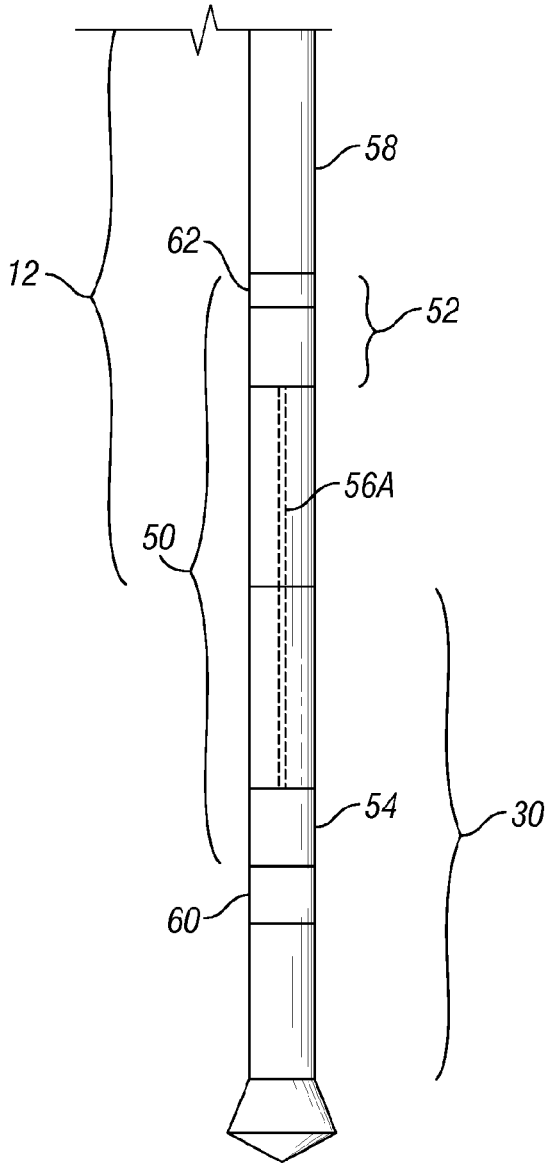
FIG. 5B shows a portion of a wellbore communication system in accordance with another embodiment of the invention.

FIGS. 5A and 5B depict one or more telemetry kits 50 positioned about various portions of the wired drill pipe telemetry system 58 and the downhole tool to pass signals therebetween. In the example shown, the telemetry kits 50 are provided with cables 56*a*. The telemetry kits 50 may be located in the drillstring 12 and/or an upper portion of the BHA 30. FIG. 5A schematically depicts a downhole portion of the wellbore communication system 33 of FIG. 1. As shown in FIG. 5A, the WDP telemetry system 58 is operatively connected to the BHA 30 via two telemetry kits 50*a*, 50*b*. The telemetry kits 50*a*, 50*b* are disposed below the WDP 58.

The telemetry kits 50*a*, 50*b* may be operatively connected to the WDP telemetry system 58 and/or the BHA 30 via a variety of operative connections. As shown, the operative connection may be a telemetry sub 60, a telemetry adapter 62 and/or additional drill pipes 64 having a communication link for passing signals from the kit(s) to the WDP telemetry system 58 and/or the downhole tool. The telemetry sub 60 is adapted for connection with various components in the BHA 30 for communication therewith. The telemetry sub 60 may be provided with a processor for analyzing signals passing therethrough.

The additional drill pipes 64 are provided with communication devices and processors for analyzing signals and communicating with the telemetry kits 50*a*, 50*b*. The telemetry adapter 62 is adapted for connection to the WDP telemetry system 58 for communication therewith. The various operative connections may function to, among other things, interface between WDP telemetry system 58, BHA 30, and other components to enable communication therebetween. The operative connections may include WDP and/or non-WDP diagnostics, sensors, clocks, processors, memory, and/or a power generator. Optionally, the operative connections 62, 64 and 60 can be adapted for connection to one or more types of WDP telemetry systems.

A terminal 52 of an upper telemetry kit 50*a* is operatively connected to the WDP telemetry system 58 via telemetry adapter 62. The WDP telemetry system and/or the telemetry kit 50*a* may include one or more repeater subs (not shown) for amplifying, reshaping, and/or modulating/demodulating a signal transmitted through the telemetry kit 50*a* and WDP telemetry system 58.

In the example of FIG. 5A, two telemetry kits 50*a*, 50*b* are shown. Where a plurality of telemetry kits 50 are used, additional drill pipe(s) 64, containing tools such as measurement tools and/or sensor subs 64, may be disposed between the telemetry kits 50. A lower terminal 54 of the lower telemetry kit 50*b* is operatively connected to a downhole telemetry sub 60 of the downhole tool. The downhole telemetry sub 60 is one component of the operative connection between telemetry kit 50*b* and one or more tools located in the BHA 30. Communications between a downhole telemetry sub 60 and such tools may utilize a standardized language between the tools, such as a signal protocol, or may have different languages with an adapter therebetween for translation. As shown in FIG. 5A, the downhole telemetry sub 60 may be positioned in the BHA 30 such that the lower telemetry kit 50*b* traverses an upper portion of the BHA 30. Alternatively, the downhole telemetry sub 60 may be located between the drill string 12 and BHA 30 such that the operatively connected lower telemetry kit 50*b* is disposed above the BHA 30, in the drillstring 12.

The tools to which the downhole telemetry sub 60 may operatively connect may include one or more LWDs, MWDs, rotary steerable systems (RSS), motors, stabilizers and/or other downhole tools typically located in the BHA 30. By bypassing one or more such components, it eliminates the need to establish a communication link through such components. In some cases, the ability to bypass certain components, such as drilling jars, stabilizers, and other heavy weight drill pipes, may allow for certain costs to be reduced and performance to be enhanced.

As shown in FIG. 5B, a telemetry kit 50 may extend through a portion of drillstring 12, below a portion of the WDP telemetry system 58 and into an upper portion of the BHA 30. By bypassing the upper portion of the BHA 30, the telemetry kit 50 is intended to traverse the portion of the drillstring 12 occupied by such components.

As shown in FIG. 5B, one or more of the operative connections may be incorporated into the telemetry kit 50. The telemetry adapter 62 is functionally positioned within the telemetry kit 50 to provide the communication connection with the WDP system 58. Similarly, while the telemetry sub 60 is shown as a separate item from the telemetry kit 50, the telemetry sub 60 could be integral with the telemetry kit 50.

A downhole telemetry sub 60 is disposed in the BHA 30 and is operatively connected to one or more components (not shown) disposed in the lower portion of the BHA 30 (e.g., LWDs, MWDs, rotary steerable systems, motors, and/or stabilizers). Optionally, the downhole telemetry sub 60 may be located above or in between various tools, such as the LWD/MWD tools of the BHA 30, and operatively connected to the telemetry kit 50 and the tools of the BHA 30. As previously discussed, the downhole telemetry sub 60 operatively connects to terminal 54 of the telemetry kit 50, and may be integrated with the terminal 54 of the telemetry kit 50.

While FIGS. 5A and 5B depict specific configurations for placement of a telemetry kit 50 in a wellbore communication system, it will be appreciated that one or more telemetry kits 50 may be positioned in one or more drill collars. The telemetry kit(s) 50 may extend through a portion of the drill string 12 and/or a portion of the downhole tool. The telemetry kit 50 is preferably positioned to provide a communication link between the wired drill pipe telemetry system 58 and the downhole components. In this manner, the telemetry kit 50 may bypass devices that may impede communications and/or provide an efficient link between portions of the drill string 12 and/or downhole tool.

Figure 6A:
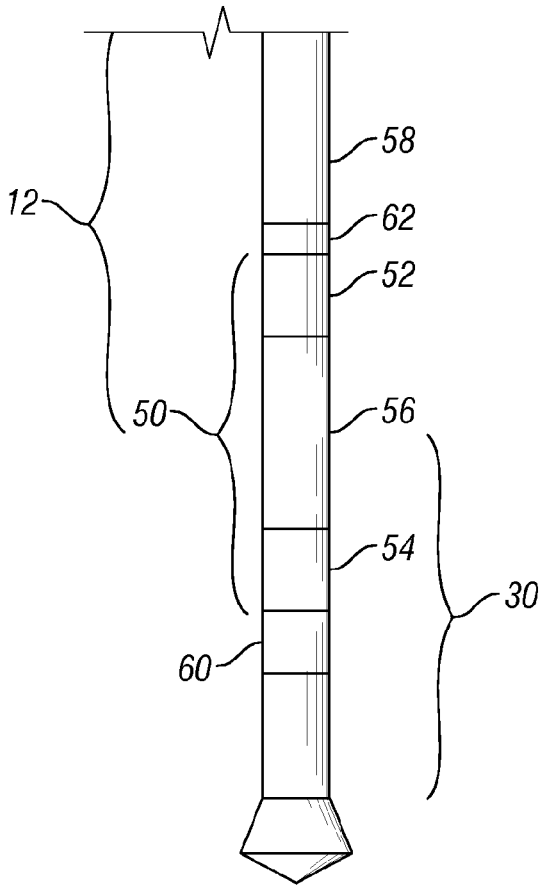
FIG. 6A shows a portion of a wellbore communication system in accordance with an embodiment of the invention.
Figure 6B:
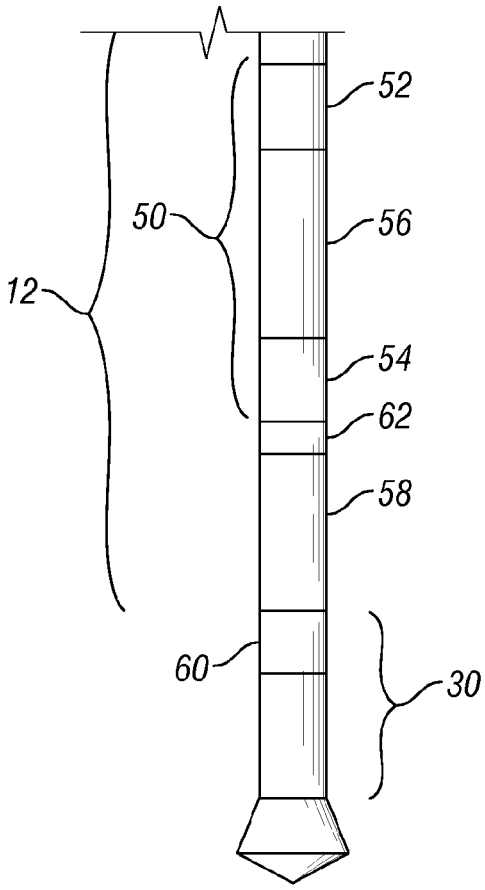
FIG. 6B shows a portion of a wellbore communication system in accordance with another embodiment of the invention.

Referring now to FIGS. 6A and 6B, additional configurations depicting a telemetry kit 50 are provided. In the examples shown in FIGS. 6A and 6B, the telemetry kit 50 does not require a wire 56*a*. The telemetry kit 50 has a specialized pipe 56*b* in place of the wired transmission element 56*a* (e.g., cable) of the telemetry kit 50 used in FIGS. 5A and 5B. This specialized drill pipe may be, for example, a conductive drill pipe having a metal portion extending between the terminals. The metal portion is adapted to pass a signal between the terminals. Examples of such techniques for passing signals between terminals using metal piping are disclosed in U.S. Pat. Nos. 4,953,636 and 4,095,865. At least one telemetry kit 50 is operatively connected to a WDP telemetry system 58 of the drill string 12 such that a signal may be passed between the surface telemetry sub (45 in FIG. 1) and the BHA 30.

As shown in FIG. 6A, the telemetry kit 50 is positioned between the WDP telemetry system 58 and the BHA 30. A telemetry adapter 62 operatively connects the WDP telemetry system 58 to terminal 52 of the telemetry kit 50. A downhole telemetry sub 60 connects to or is integral with a downhole terminal 54 of the telemetry kit 50. The downhole telemetry sub 60 forms an operative connection between the telemetry kit 50 and one or more components of the BHA 30.

As previously described, the telemetry kit 50 may be disposed such that it traverses an upper portion of the BHA 30 and operatively connects to one or more tools disposed in the lower portion of the BHA 30. Signals passed through examples utilizing specialized drill pipe as a transmission element 56 will typically pass conductively. However, the terminals 52, 54 may be configured to pass the signal to adjacent components of the drill string 12.

The example shown in FIG. 6A depicts a telemetry kit 50 traversing a portion of the BHA 30. However, the telemetry kit 50 may traverse at least a portion of the WDP telemetry system 58 and/or the BHA 30 as desired.

Referring now to FIG. 6B, the telemetry kit 50 is located above the WDP telemetry system 58. Downhole terminal 54 of the telemetry kit 50 is operatively connected to the WDP telemetry system 58 via telemetry adapter 62. At its upper end, an uphole terminal 52 of the telemetry kit 50 operatively connects to the surface telemetry sub (45 in FIG. 1). An additional telemetry adapter 62 may be positioned between the telemetry kit 50 and the surface telemetry sub 45 for passing a signal therebetween. The surface telemetry sub 45 may be integral with the upper terminal 52 of the telemetry kit 50 and/or the telemetry adapter 62. At its downhole end, the WDP telemetry system 58 is operatively connected to the BHA 30 by means of a telemetry sub 60, as previously described.

It may be desirable in various configurations to configure the subs 45, 60 and/or telemetry adapters 62 of the downhole system to include one or more transmitters and/or sensors in order to maintain one or two-way communications with a surface control unit 4. In various configurations, it may be desirable to operatively connect subs 45, 60 and/or telemetry adapter 62 to one or both ends of a telemetry kit 50, WDP telemetry system 58, or specialized (e.g., conductive) pipe. One or more of the various operative connectors may be integral with or separate from portions of the telemetry kit 50, such as an adjacent terminal, and/or portions of the WDP telemetry system 58 and/or BHA 30. Various combinations of the various telemetry kits 50 with one or more WDP telemetry systems 58, BHAs 30 and/or operative connections may be contemplated. For example, a telemetry kit 50 with a cable may be positioned uphole from the WDP telemetry system 58 as shown in FIG. 6B.

FIGS. 7-10 depict a wellsite system 700 with a wellsite communication system 33*a*. FIGS. 7-10 show, in sequence, one technique for assembling the wellsite communication system 33*a*. The wellsite system 700 is essentially the same as the wellsite system of FIG. 1, except that the downhole system includes the BHA (downhole tool) 30*a*, a hybrid telemetry system 702 deployable into the drill string 12, and a drill string telemetry system 742 (FIGS. 8-10) operatively connected thereto. In this configuration, signals may be passed between the BHA 30*a* and the surface unit 4 via the hybrid telemetry system 702 and the drill string telemetry system 742.

Figure 7:
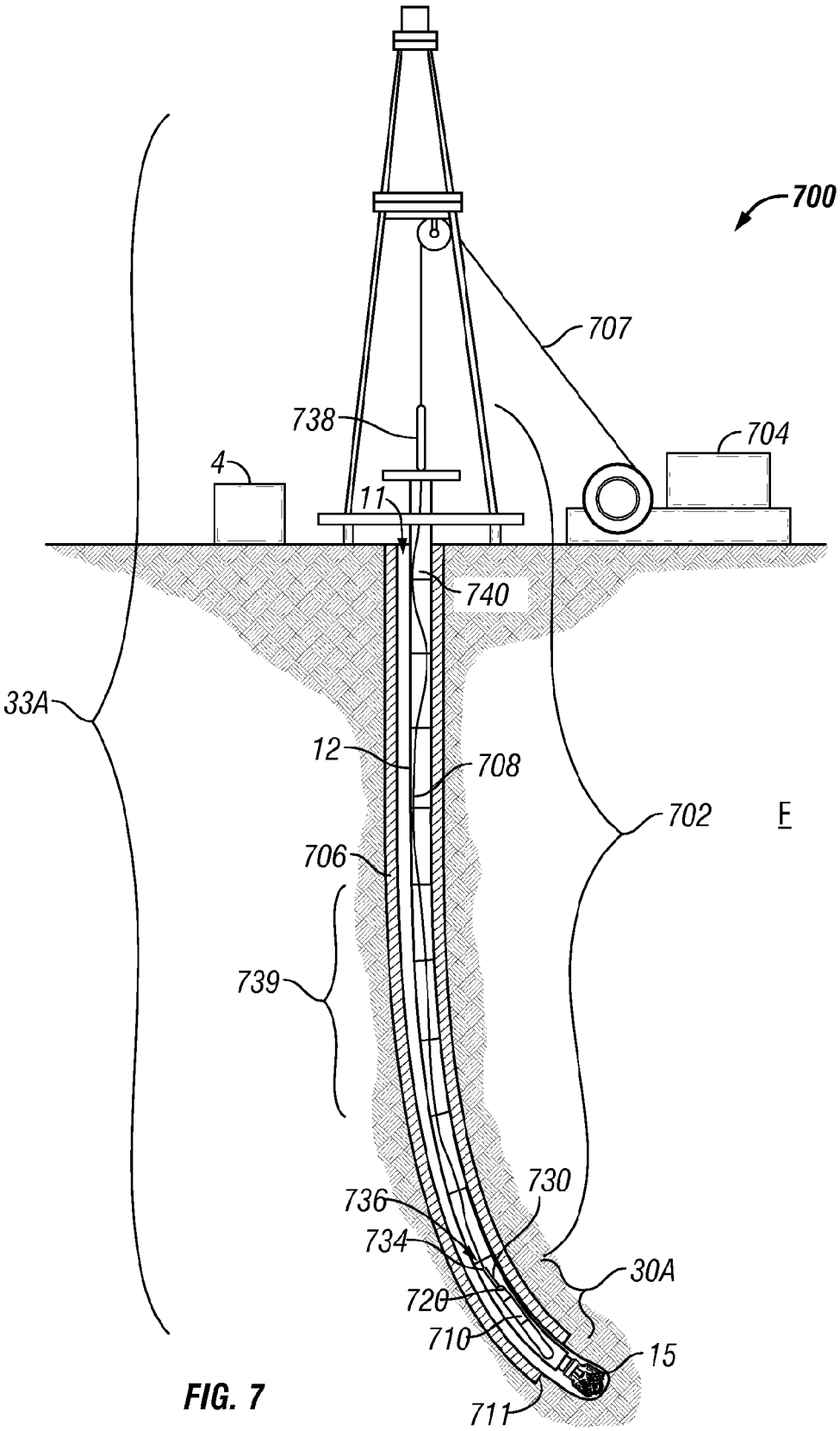
FIG. 7 is a schematic diagram of a wellsite system in accordance with an embodiment of the invention.

Referring first to FIG. 7, the downhole drilling tool has advanced into the subterranean formation to form the wellbore 11. The drilling tool has been removed, and casing 706 has been run into the wellbore 11 and secured in place. A BHA 30*a* with a bit 15 at an end thereof has been advanced into the cased wellbore 11. The BHA 30*a* may be the same as BHA 30 previously described herein, except that it is provided with a mated BHA connector 730. The mated BHA connector 730 is preferably adapted to releasably connect to a corresponding mated connector when attached thereto. The BHA connector 730 may be positioned at an uphole end of the BHA 30*a* for receiving a mated connector. The BHA connector 730 may also be positioned within the BHA 30*a* such that a portion of the hybrid telemetry system 702 traverses a portion of the BHA 30*a*.

BHA 30*a* is provided with sensors 710 for collecting data. These sensors are preferably high resolution MWD/LWD sensors, such as the current LWD systems. The BHA 30*a* also has a telemetry transceiver 720. As shown, the telemetry transceiver 720 is positioned at an upper end of the BHA 30*a* with the BHA connector 730 operatively connected thereto. The BHA connector 730 is also operatively connected to the hybrid telemetry system 702 for transmitting signals between the BHA 30*a* and the hybrid telemetry system 702. For example, data from the sensors 710 is passed from the BHA 30*a* to the hybrid telemetry system 702 when in place. The telemetry transceiver 720 may be the same as the telemetry sub 60 described above.

Drill string 12 is formed as drill pipes 739 are added and the BHA 30*a* is advanced into the wellbore 11. The BHA 30*a* is run down the casing 706 by adding drill pipes 739 to form the drill string 12 and reach the desired depth. The BHA 30*a* is typically stopped when the bit 15 arrives at the casing shoe 711. While FIGS. 7-11 show telemetry systems in partially-cased wellbores, the telemetry systems may be used in cased or uncased wellbores (FIG. 1).

At this time, the hybrid telemetry system 702 may be run into the drill string 12 using a winch system 704. The winch system 704 lowers the hybrid telemetry system 702 into the drill string 12 and mud is pumped into the drill string 12 to push the hybrid telemetry system 702 into position. Examples of such winch deployment systems are known in the industry. For example, a Tough Logging Conditions (TLC) system provided by Schlumberger may be used.

The hybrid telemetry system 702 includes a cable 708 with a downhole connector 734 and an uphole connector 738 at respective ends thereof. The hybrid telemetry system 702 may be the same as the telemetry kit previously described. As shown in FIG. 7, the hybrid telemetry system 702 is positioned in the drill string 12 and operatively connected to the BHA 30*a* at a downhole end thereof. The uphole end of the hybrid telemetry system 702 is supported by a hoist 707 of the winch system during this step of the assembly process.

The connectors (734, 738) may be the same as the terminals 52, 54 previously described herein. Preferably, the connectors 734, 738 releasably connect the ends of the cable 708 for operative connection with adjacent components. The downhole connector 734 may be, for example, latched into position. An example of a latching system is depicted in U.S. Patent Publication No. 2005/10087368, assigned to the assignee of the present invention. The downhole connector 734 may be operatively coupled to an adjacent component using, for example, an inductive coupling. The downhole connector 734 may be, for example a wet connector operable in mud, that matingly connects with BHA connector 730 to form a downhole or BHA wet connection 736. A wet connector may be used to allow the connections to work in an environment of any well fluid.

As shown in FIG. 7, the hybrid telemetry system 702 is releasably connected to the BHA 30*a* via wet connection 736. The BHA connector 730 of the wet connection 736 is operatively connected to a telemetry module 720 (or telemetry sub 60) in the BHA 30*a*. Thus, connection 736 permits selective connection of the hybrid telemetry system 702 to the BHA 30*a* for communication therebetween.

The cable 708 extends from downhole connector 734 to uphole connector 738. The length of the cable 708 may vary as desired. Typically, as shown in FIGS. 7-10, the cable 708 is the length of the casing 706. Preferably, sufficient slack remains in the cable 708 to facilitate operation of the telemetry systems. The cable 708 may be the same as cable 56*a* described above. The cable 708 may be loose within the drill string 12, or secured along the drill string 12. Examples of techniques for securing a cable in place are described in U.S. patent application Ser. No. 10/907,419, assigned to the assignee of the present invention.

In one example, the cable 708 may be a fiber optic cable for communicating through the hybrid telemetry system 702. In cases where a fiber optic cable is used, optical-to-electrical and electrical-to-optical converters (not shown) may be used to pass signals between the optical hybrid telemetry system 702 and adjacent electrical components. For example, the telemetry module in the BHA 30*a* can be provided with an optical-to-electrical converter for passing signals to a fiber optic cable of the hybrid telemetry system 702, and an electrical-to-optical converter can be provided in an uphole telemetry system, such as the drill string telemetry system 742 (described below), for receiving signals from the hybrid telemetry system 702.

During the assembly process, it may be desirable to support the weight of the cable 708 by clamping it at a surface location using the uphole connector 738. The cable 708 may be, for example, hung off in a special crossover. The cable 708 may also be clamped to a landing sub 740 supported by the drill pipe nearest the surface. The landing sub 740 may rest in the top drill pipe of the drill string 12 with the drill pipe supported on the rotary table 16 (shown in FIG. 1) by slips (not shown).

Figure 8:
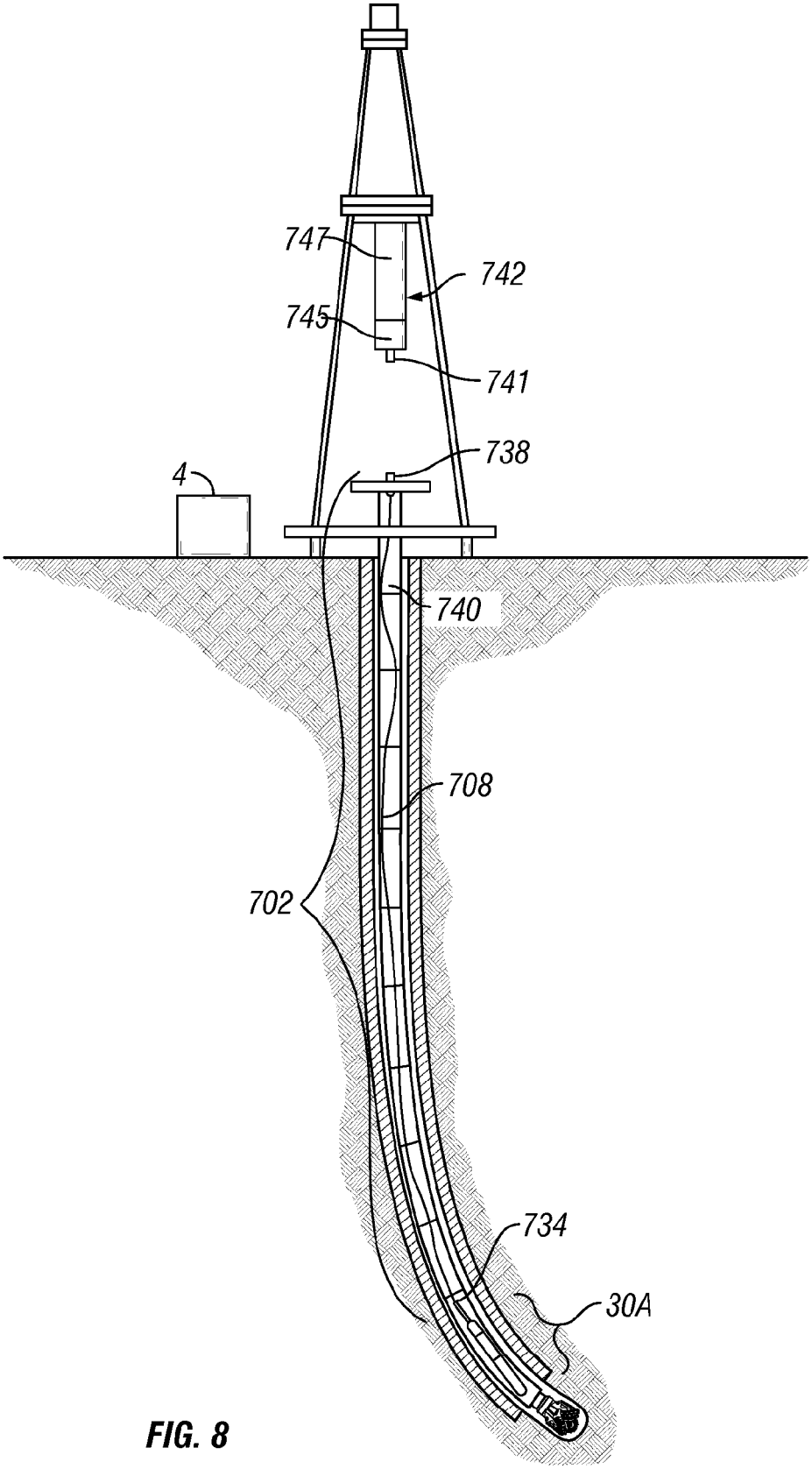
FIG. 8 is a schematic diagram of a wellsite system in accordance with the embodiment of FIG. 7.

Referring now to FIG. 8, the cable 708 is cut off and terminated with uphole connector 738. The uphole connector 738 may be the same as downhole connector 734 or, for example, a quick connect. Preferably, the uphole connector 738 releasably connects an uphole end of the hybrid telemetry system 702 to an adjacent component for communication therewith. As shown in FIG. 8, the uphole connector 738 is being prepared to operatively connect the hybrid telemetry system 702 to a drill string telemetry system 742 (or relay station) such that the drill string telemetry system 742 communicates with the BHA 30*a* via the hybrid telemetry system 702.

As depicted, the drill string telemetry system 742 includes a telemetry adapter 745 and a telemetry unit 747. The telemetry adapter 745 may be the same as the telemetry adapter 62 previously described herein for operatively connecting the drill string telemetry system 742 to the hybrid telemetry system 702 for communication therebetween. The drill string telemetry system 742 may be provided with one or more telemetry adapters 745 or a direct link system. The additional direct link system may be similar to known steering tool technology equipped at its bottom end to receive the quick connect and electronics to transform the wireline telemetry into the MWD telemetry format.

The telemetry adapter 745 may be provided with a drill string telemetry connector 741 for matingly connecting with the uphole connector 738. The drill string telemetry connector 745 may be positioned at a downhole end of the drill string telemetry system 742, or within the drill string telemetry system 742 such that a portion of the hybrid telemetry system 702 traverses a portion of the drill string telemetry system 742. The uphole and drill string connectors operatively connect the hybrid telemetry system 702 with the drill string telemetry system 742 for communication therebetween.

The drill string telemetry system 742 may be provided with one or more telemetry units 747. As shown, the telemetry unit 747 is a mud pulse telemetry unit. However, it will be appreciated that the telemetry unit 747 may be any type of telemetry system, such as mud pulse, sonic, electromagnetic, acoustic, MWD tool, drill pipe or other telemetry system capable of sending signals to or receiving signals from the surface unit 4.

Figure 9:
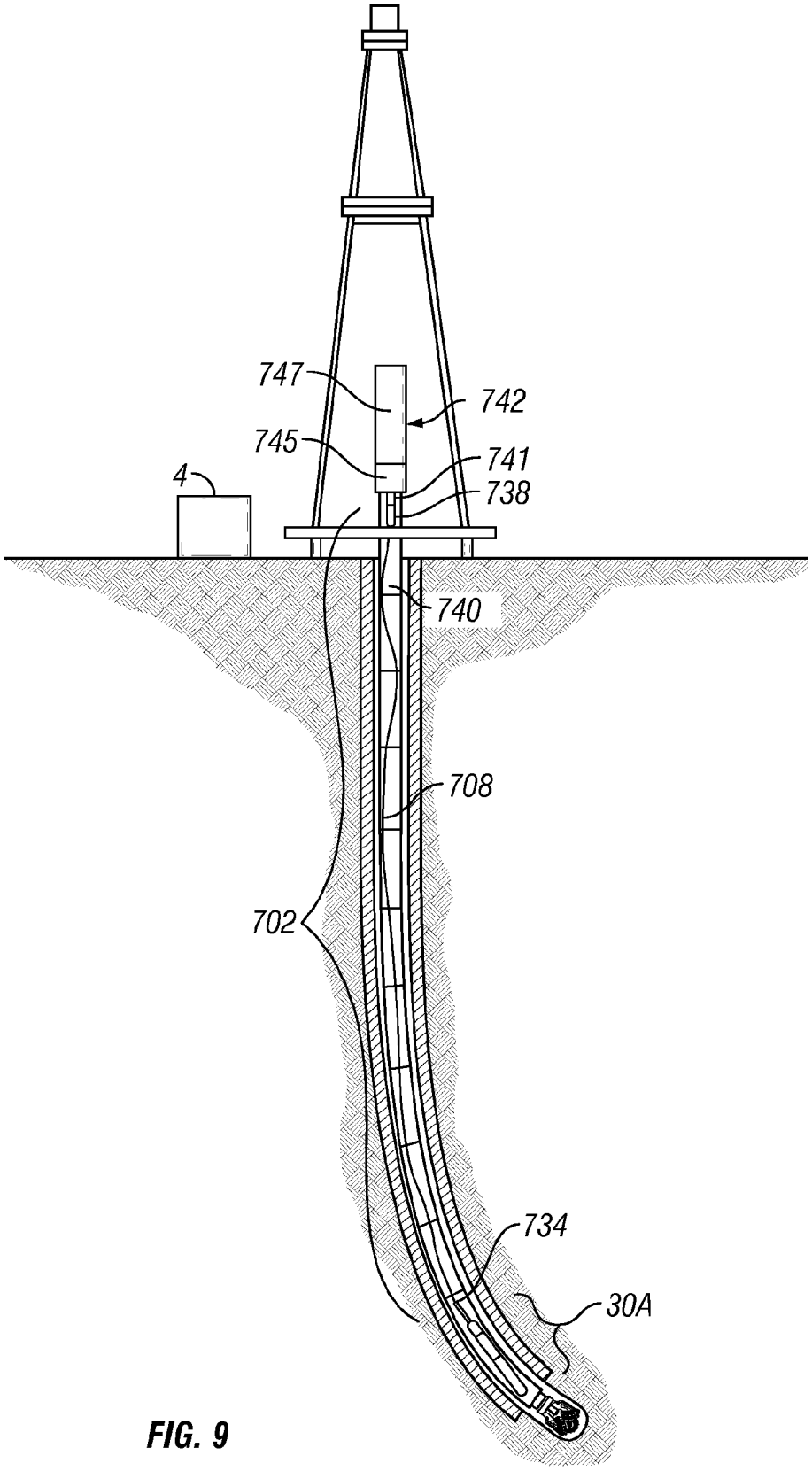
FIG. 9 is a schematic diagram of a wellsite system in accordance with the embodiment of FIG. 7.

During assembly as shown in FIGS. 8 and 9, the drill string telemetry system 742 is lifted above the rig floor by a hoist (not shown) and lowered onto the landing sub 740 at the surface. The drill string telemetry connector 741 is then connected with uphole connector 738 for the passage of signals. Preferably, the connectors are releasably connected such that they may be removed as desired. Uphole connector 738 may be operatively connected to the drill string 12 using a latch mechanism as previously described with respect to downhole connector 734.

The drill string telemetry system 742 may be selectively positioned along the drill string 12. The length of the cable 708 and the number of drill pipes may be adjusted such that the drill string telemetry system 742 is in the desired position. The hybrid telemetry system 702 may also be positioned and secured in place as desired in or about the drill string telemetry system 742, the drill string 12 and/or the BHA 30*a*.

Figure 10:
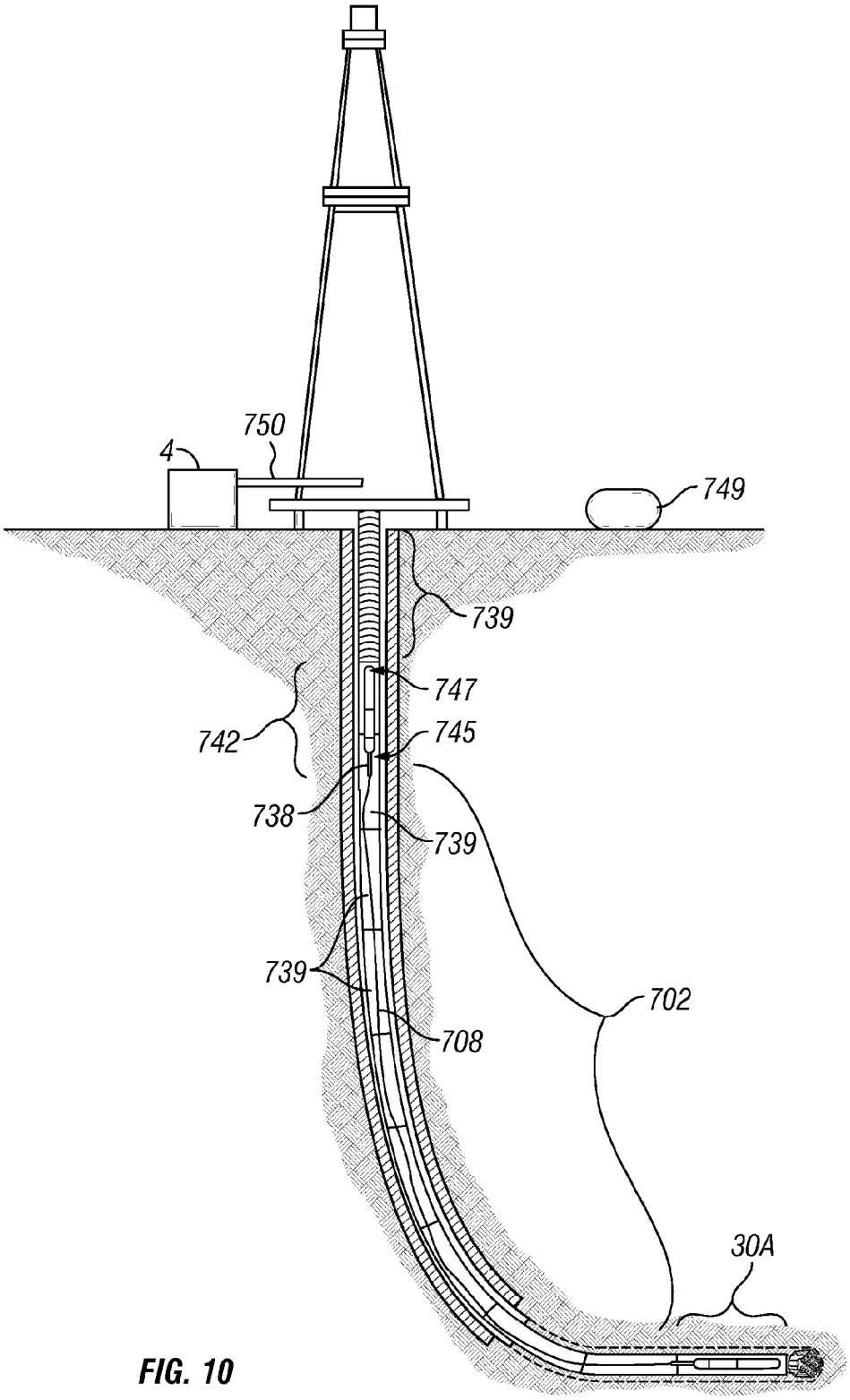
FIG. 10 is a schematic diagram of a wellsite system in accordance with an embodiment of the invention.

Once in position as shown in FIG. 10, the wellsite system may be used to drill as usual, by attaching additional drill pipes 739 on top of the drill string telemetry system 742. Mud is pumped through the wellsite using mud pump system 749. Mud pump system 749 may operate the same as the mud pump system described with respect to FIG. 1. The BHA 30*a* may then be advanced into the earth and rotationally driven as previously described.

The hybrid telemetry system 702 between the BHA 30*a* and the drill string telemetry system 742 is now positioned in the wellbore below the surface. Once the downhole sensors extend beyond the casing shoe, data collection may begin. Data may then be sent through the BHA 30*a* and to the hybrid telemetry system 702. From the hybrid telemetry system 702, signals may then be passed to the drill string telemetry system 742. Signals are then passed from the drill string telemetry system 742 to the surface unit 4. The signals from the drill string telemetry system 742 may now be detected at the surface by surface sensor 750 and decoded by the surface unit 4. Signals may also be sent from the surface unit 4 back to the BHA 30*a* by reversing the process. Preferably, the system permits such communication during normal drilling operations.

Figure 11:
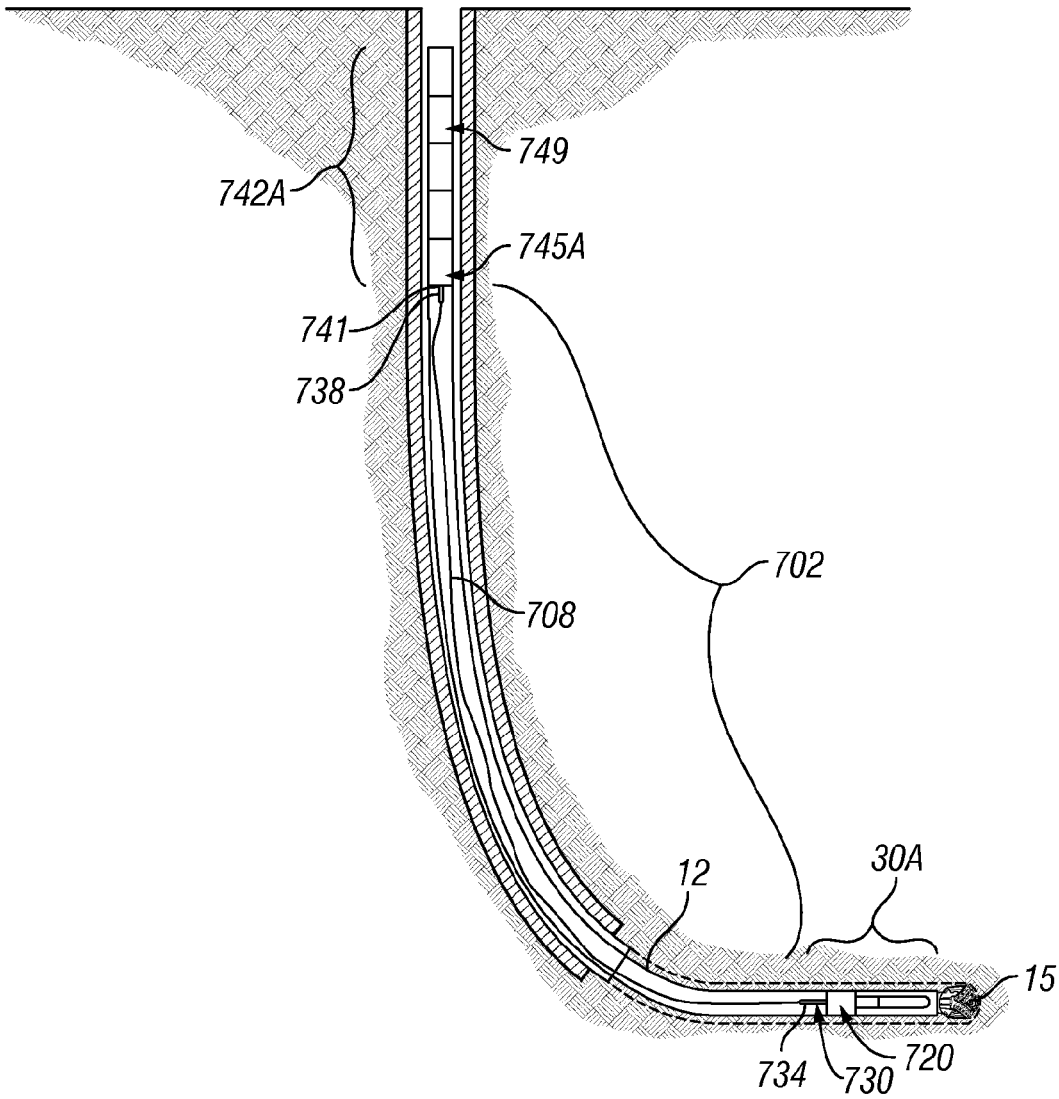
FIG. 11 is a schematic diagram of a downhole portion of a wellsite system in accordance with another embodiment of the invention.

FIG. 11 depicts a downhole portion of the wellsite of FIG. 10 using an alternate drill string telemetry system 742*a*. FIG. 11 is essentially the same as FIG. 10, except that the drill string telemetry system is depicted as a wired drill pipe (WDP) telemetry system 742*a* made of a series of wired or wireless drill pipes (WDPs) 749.

The WDP telemetry system 742*a* may be the same as the WDP telemetry system 58 having WDPs 40 as previously described herein. The WDP telemetry system 742*a* may communicate with the surface in the same manner as described previously with respect to WDP telemetry system 58. As shown, the drill string telemetry system 742*a* also includes a telemetry adapter 745*a*. The telemetry adapter 745*a* may be the same as the telemetry adapters 745 and/or 62 with a drill string connector 739 as previously described.

In the exemplary method of FIG. 11, the hybrid telemetry system 702 is installed in the drill string 12 to link the drill string telemetry system 742*a* to various components (such as MWD/LWD tools) in the BHA 30*a*. The downhole connector 734 may be installed in the drillstring 12 and operatively connected to the BHA 30*a* via BHA connector 730. The hybrid telemetry system 702 is installed by pumping the downhole end of the hybrid telemetry system 702 down the drill pipe inner diameter using the TLC technique described previously. The connecting process results in the cable connector latching and seating with the BHA connector 730 of telemetry sub 60. The top of the cable is terminated and prepared for connection with in the drill string telemetry system 742*a*.

One or more WDPs 40 may then be added to the top of the drill string 12 to form the drill string telemetry system 742*a*. Preferably, the telemetry adapter 745*a* is positioned in or adjacent to a WDP 40 at a downhole end of the drill string telemetry system 742*a*. The uphole connector 738 is operatively connected with the drill string connector 741 of the telemetry adapter 745*a*. One or more WDPs 40 are then added to complete the assembly process.

During installation, it is possible to deploy any number of WDPs. The entire drill string may be WDPs. However, it may be desirable to use a limited number of WDPs so that they remain near the surface. In cases where WDP reliability is a concern, it may be desirable to reduce the number of WDPs and extend the length of the hybrid telemetry system to span the remainder of the drill string. In such cases, a given number of WDPs may be used to support high-speed bidirectional communication to tools/sensors in the BHA. It may be desirable to use relatively few wired drill pipes (i.e., 1,000 feet (304.8 km)) at the top of the well, and extend the cable through the remainder of the drill string to reach the BHA. The hybrid telemetry system may extend through one or more WDPs. In such cases, a redundant or overlapping telemetry system may be provided.

Referring back to FIG. 10, in an alternative embodiment of the present invention, the drill string telemetry system 742 may include one or more WDPs in addition to the telemetry unit 747 (i.e., the mud pulse telemetry unit of FIG. 10). Thus, in such an embodiment the drill string telemetry system 742 may include a combination of the telemetry unit 747 of FIG. 10 and the WDP telemetry system 742*a* of FIG. 11. For example, once the telemetry unit 747 is positioned in the drill string telemetry system 742, one or more WDPs may then be positioned in the drill string telemetry system 742 on top of the telemetry unit 747 such that an upper section of the drill string telemetry system 742 is composed of one or more WDPs. Alternatively, one or more WDPs may be positioned in the drill string telemetry system 742 below the telemetry unit 747 such that a lower section of the drill string telemetry system 742 is composed of one or more WDPs.

Figure 12:
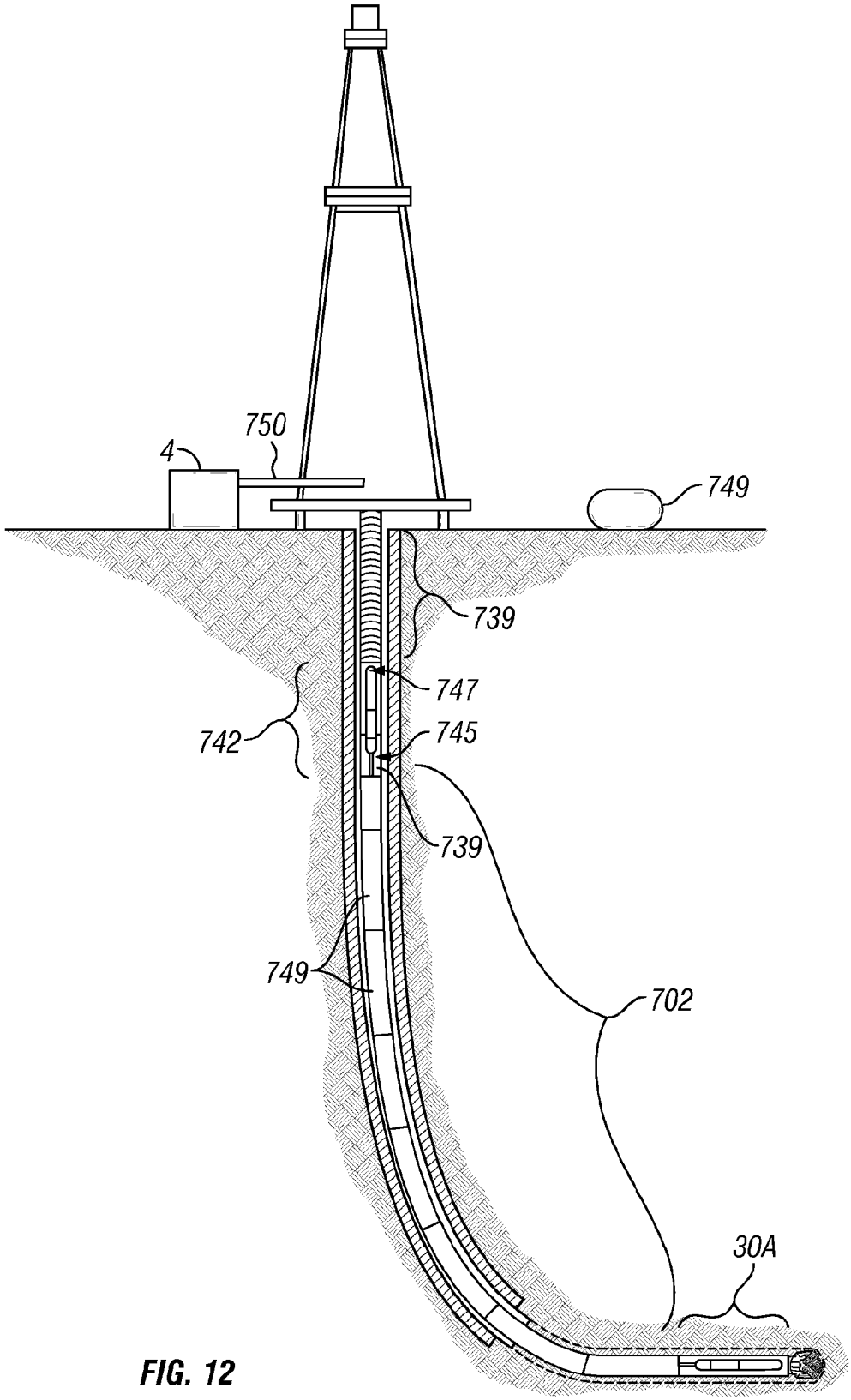
FIG. 12 is a schematic diagram of a wellsite system in accordance with another embodiment of the invention.

FIG. 12 shows an alternate embodiment of the wellsite system depicted in FIG. 10. FIG. 12 is essentially the same as FIG. 10, except that the hybrid telemetry system 702 is composed of a series of wired or wireless drill pipes (WDPs) 749. Thus, rather than a cable connecting a lower end of the hybrid telemetry system 702 to the upper end thereof, the series of WDPs 749 operatively connect the two ends. For example, one WDP 749 located near the BHA 30*a* connects with the BHA 30*a*, and another WDP 749 located near the drill string telemetry system 742 connects therewith. Thus, the hybrid telemetry system 702 composed of WDPs 749 may relay data between the BHA 30*a* and the drill string telemetry system 742.

The drill string telemetry system may extend a desired portion of the drill string. Depending on the desired length of the drill string telemetry system, the number of WDPs and the number of regular drill pipes may be adjusted to provide the desired length of WDPs at the desired location in the wellbore. As described with respect to FIGS. 5A-6B, one or more sections of a wired drill pipe or hybrid telemetry system may be used in combination with one or more kits or hybrid telemetry systems to achieve the desired configuration.

The overall communication system is preferably configured to support very high data rates for bi-directional communication between the BHA and the surface. The hybrid telemetry system may be adapted to work with any BHA configuration. The hybrid telemetry system may also be configured such that it provides an overall simpler drilling assembly. A typical BHA may include drilling jars, heavy weight drill pipes, drill collars, a number of cross-overs and/or MWD/LWD tools.

In some cases, the hybrid telemetry system may be deployed into the drill string and the sensors run to the casing shoe as previously described. Alternatively, the hybrid telemetry system may be pre-fabricated using a pre-determined length of cable with the connectors and landing sub pre-installed. In such prefabricated situations, the position of the downhole sensors will be matched with the length of cable. It may also be possible to prefabricate the hybrid telemetry system such that all or portions of the hybrid telemetry system are secured in position. For example, it may be desirable to attached the cable to the inner surface of the drill string. In another example, it may be desirable to releasably or non-releasably secure the connectors in place.

The hybrid telemetry system may optionally be retrieved by simply reversing the assembly process. In some cases, a fishing tool may be used to reach through the drill string inner diameter and retrieve the downhole components. All or part of the drill string telemetry system, the hybrid telemetry system and/or the BHA may be retrieved by fishing. These components may be provided with fishing heads (not shown) to facilitate the retrieval process, as is well known in the art.

Preferably, the configuration of the wellsite system is optimized to provide low attenuation and high data rates without interfering with the drilling rig maneuvers. The configuration of the BHA to hybrid telemetry system to drill string telemetry system to surface unit may be used to transmit more sophisticated downhole commands such as variation of hydraulic parameters (i.e., flow, pressure, time) performed on the rig, where the reduced attenuation allows higher frequency content. Depending on the application, it may be desirable to use a certain type of telemetry unit in the drill string telemetry depending on the depth of the well, the downhole conditions or other factors. For example, in some cases, it may be preferable to use MWD telemetry, i.e., sonic waves in the drill pipe, which would normally be limited by attenuation.

The hybrid telemetry system may be adapted in length to assist with the attenuation and data rate. Such signal attenuation may limit the depth range and transmission rate of current MWD systems. Moreover, the hybrid telemetry system may be configured to speed up the MWD transmission by allowing a higher mud telemetry frequency which would normally be limited by attenuation.

It may be desirable to position the drill string telemetry system nearer to the surface to avoid harsh downhole conditions. The hybrid telemetry system may be positioned in the drill string to span the portion of the system that is exposed to harsh conditions. For example, the hybrid telemetry system is positioned in the drill string where mud flows so that BHA components, such as the telemetry sub, power supplies, high density memory, and other components, may be secured within the BHA where they are isolated and protected from downhole conditions. The hybrid telemetry system may be positioned in exposed or vulnerable portions of the wellbore to improve reliability by minimizing the number of components exposed to high temperature and high pressure conditions. The hybrid telemetry system may also be used in wells with doglegs to span portions of the tool subject to significant bending and to assist in providing better life and/or reliability.

The drill string telemetry system may also be retrievable from the drilling tool such that easy access to the drill string telemetry system is provided by allowing mechanical back off below the drill string telemetry system. The drill string telemetry system may be positioned within the cased portion of the wellbore to reduce the probability of sticking. The drill string telemetry system may be removed using fishing instruments to reduce lost in hole costs. Preferably, the drill string telemetry system remains in a vertical section of the hole to facilitate removal thereof.

The drill string telemetry system may also be used to provide a synchronization between a shallow clock (not shown) positioned inside of the drill string telemetry system and a deep clock (not shown) located with the downhole sensors in the BHA. This may be used, for example, with seismic while drilling operations. The clocks may also be used to provide a synchronization between a surface clock (not shown) and the shallow clock by a wireline and wet connection system. Where the drill string telemetry system is at a relatively shallow depth, a fast connection may be used between the surface unit and the drill string telemetry system. This connection may be used, for example, to perform steering operations. Preferably, the reduced depth of the drill string telemetry system may be used to allow quicker wireline access from the rig to the drill string telemetry system.

As shown in FIGS. 7-11, the hybrid telemetry system is positioned between the BHA and the drill string telemetry system. However, the hybrid telemetry system may be positioned at various locations of the drill string and BHA as previously described in FIGS. 5A-6B. For example, a portion of the hybrid telemetry system may extend into a portion of the BHA and/or drill string telemetry system. The hybrid telemetry system may also connect to the surface and provide a redundant telemetry system. Additional telemetry units may also be positioned in the BHA. Multiple hybrid telemetry systems, cables, connectors or other features may be provided at redundant and/or separate locations in the wellbore communication systems.

Unless otherwise specified, the telemetry kit, WDP, telemetry subs, telemetry adapters, hybrid telemetry systems, drill string telemetry systems and/or other components described in various examples herein may be disposed at any location in the drillstring, and with respect to each other. Furthermore, it may be advantageous to combine telemetry kits 50 with or without cables 56*a* within the same wellsite system 1. The particular configurations and arrangements described are not intended to be comprehensive, but only representative of a limited number of configurations embodying the technologies described.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A downhole telemetry system, comprising:

a wired drill pipe ("WDP") telemetry system comprising a plurality of inductively connected WDPs;

a telemetry adapter configured to provide a communication connection with the WDP telemetry system; and a downhole tool operatively connected to the WDP telemetry system via the telemetry adapter;

wherein the telemetry adapter comprises:

a first connector configured to inductively connect the adapter to a WDP; and a second connector configured to non-inductively connect the adapter to the downhole tool.

2. The downhole telemetry system of claim 1, wherein the telemetry adapter comprises a transmitter configured to communicate with a surface control unit.

3. The downhole telemetry system of claim 1, wherein the downhole tool is a measurement while drilling tool.

4. The downhole telemetry system of claim 1, wherein the downhole tool is a logging while drilling tool.

5. The downhole telemetry system of claim 1, wherein the drill string telemetry connector is disposed at one of a downhole end of the WDP telemetry system and a location within the WDP telemetry system.

6. The downhole telemetry system of claim 1, wherein the telemetry adapter is disposed within or adjacent to a WDP at a downhole end of the WDP telemetry system.

7. The downhole telemetry system of claim 1, wherein the telemetry adapter is configured to provide communication and power signals to the downhole tool.

8. The downhole telemetry system of claim 1, wherein the downhole tool is a wireline tool.

9. The downhole telemetry system of claim 1, wherein the first connector is releasably connectable to the WDP telemetry system and the second connector is releasably connectable to the downhole tool.

10. The downhole telemetry system of claim 1, further comprising a cable that operatively connects the telemetry adapter to the downhole tool.

11. The downhole telemetry system of claim 10, wherein a downhole connector is connected to the cable and is configured to inductively couple to the downhole tool.

12. The downhole telemetry system of claim 10, wherein the telemetry adapter comprises a drill string telemetry connector configured to matingly connect with an uphole connector of the cable.

13. A method for communicating with a downhole tool, comprising:

connecting a plurality of wired drill pipes ("WDPs") via inductive coupling elements of the WDPs;

connecting a telemetry adapter at a downhole end of the WDPs via an inductive connector at an uphole end of the telemetry adapter;

connecting a downhole tool to the telemetry adapter via a non-inductive connection at a downhole end of the telemetry adapter; and communicating with the downhole tool via the WDPs and the telemetry adapter.

14. The method of claim 13, further comprising communicating between the telemetry adapter and a surface control unit via a transmitter included in the telemetry adapter.

15. The method of claim 13, further comprising providing power and communication signals to the tool via the WDPs and the telemetry adapter.

16. The method of claim 13, wherein the tool is a wireline tool.

17. The method of claim 13, further comprising connecting a cable between the telemetry adapter and the downhole tool.

18. The method of claim 17, further comprising coupling the cable to the tool via inductive coupling elements included in the tool and a downhole connector of the cable.

19. A downhole telemetry apparatus, comprising:

a telemetry adapter, comprising:

a first connector configured to inductively connect the adapter to a wired drill pipe ("WDP"); and a second connector configured to operatively connect the adapter to a tool downhole of the adapter;

wherein the adapter provides a communication link between the WDP and the tool;

wherein the adapter is configured to operatively connect WDP telemetry to a different telemetry system.

20. The downhole telemetry apparatus of claim 19, wherein the adapter further comprises a transmitter and a sensor providing communication between the adapter and a surface control unit.

21. The downhole telemetry apparatus of claim 19, wherein the second connector is configured to matingly connect with an uphole connector of cable disposed between the adapter and the tool.

22. The downhole telemetry apparatus of claim 19, wherein the adapter is configured to pass power and communication signals between the wire drill pipe and the tool.

23. The downhole telemetry apparatus of claim 19, wherein the tool is a wireline tool.

* * * * *